US008240585B1

(12) United States Patent
Olajos

(10) Patent No.: US 8,240,585 B1
(45) Date of Patent: Aug. 14, 2012

(54) DISHWASHER CONTROLLED GARBAGE DISPOSAL

(76) Inventor: Chet Raymond Olajos, Ochelata, OK (US)

( * ) Notice: Subject to any disclaimer, the term of this patent is extended or adjusted under 35 U.S.C. 154(b) by 224 days.

(21) Appl. No.: 12/834,194

(22) Filed: Jul. 12, 2010

(51) Int. Cl.
*B02C 25/00* (2006.01)

(52) U.S. Cl. ..... 241/36; 241/37.5; 241/46.012; 241/101.3

(58) Field of Classification Search ..... 241/36, 241/27.5, 101.3, 46.012–46.016
See application file for complete search history.

(56) References Cited

U.S. PATENT DOCUMENTS 3,108,754 A * 10/1963 Low et al. ..... 241/36
4,193,872 A 3/1980 Parkinson
4,910,808 A 3/1990 Roth
5,676,319 A 10/1997 Stiggins et al.
5,721,411 A 2/1998 Ervin
5,934,298 A 8/1999 Singh

* cited by examiner

*Primary Examiner* — Mark Rosenbaum
(74) *Attorney, Agent, or Firm* — Molly D. McKay

(57) ABSTRACT

A dishwasher controlled garbage disposal system that momentarily activates the garbage disposal upon activation of the dishwasher to clear the dishwasher's drain route through the garbage disposal. A signal detection and transmission device functionally attached to the dishwasher detects activation of the dishwasher's water pump and sends a signal to a wall mounted control module which activates a pre-operational warning timer. This timer activates for a short time a pre-activation yellow warning light and a fluctuating warning sound. When the warning timer deactivates, a disposal timer activates for a short time a red warning light, a constantly sounding warning sound, and a relay which activates the garbage disposal. A single shot latching relay within the signal detection and transmission device is activated when the dishwasher is initially turned on to prevent the control box from activating more than once during a given wash cycle of the dishwasher.

11 Claims, 2 Drawing Sheets

DISHWASHER CONTROLLED GARBAGE DISPOSAL

BACKGROUND OF THE INVENTION

1. Field of the Invention

This invention allows activation of the dishwasher to also momentarily activate the garbage disposal to thus clear out any debris that may be in the garbage disposal so that water discharged from the dishwasher is then free to flow through the garbage disposal and will not back up into the sink.

2. Description of the Related Art

The water discharge of a dishwasher installed in a home is generally plumbed so that the dirty dishwater from the dishwasher passes through the garbage disposal before discharging into the home's normal waste water disposal system. However, when food items or other debris have been placed into the garbage disposal without then running the disposal, the debris can block the disposal to such a degree that that water cannot flow through it. When the disposal is thus blocked, dirty water that is discharging from the dishwasher cannot pass through the disposal. The dirty water will then back up into the sink and can contaminate any items located in the sink, including food items. If the disposal is sufficiently blocked, the dirty dishwater can even back up to the point that it overflows the sink and can damage the floor, floor coverings, etc.

Currently, the inventor is not aware of any mechanism or device that operates automatically to insure that the garbage disposal has been cleared of debris by running the disposal prior to the dishwasher discharging dishwater into the disposal.

The present invention addresses this problem by providing a means by which the dishwasher automatically activates the garbage disposal to insure a clear path to drain for the water that is discharged from the dishwasher. This invention does not alter the normal functioning of the garbage disposal as the garbage disposal can still be manually activated and deactivated by use of a toggle switch of a wall mounted control unit employed by this invention as a replacement for the traditional wall mounted electrical switch that would normally control the function of the garbage disposal.

SUMMARY OF THE INVENTION

This invention involves three basic components that are functionally linked together: a black box signal detection and transmission device that attaches to a dishwasher, a wall mounted control module and a garbage disposal. The black box detects when the dishwasher is about to pump water out and upon detection of the dishwasher's water pump activation, the black box sends a signal to a wall mounted control module. An enlarged view of the face of the wall mounted control module is shown. The wall mounted control module replaces the existing garbage disposal switch in the home.

The wall mounted control box has a low voltage power source that converts the power from the house's power source to a lower voltage that can be used by the control box. The house's power source also supplies power to the black box, the dishwasher, and the garbage disposal.

Subcomponents of the control box are shown. When the signal from the black box is received by the receiver located within the module and when the three way toggle switch is in the ready position, the signal activates a pre-operational warning timer which in turn activates the following items for a short predetermined time interval: yellow pre-activation warning light and a fluctuating warning sound. At the end of the time interval set for the warning timer, this warning timer times out and turns off the yellow light and the fluctuating warning sound and also then activates the disposal timer.

Activation of the disposal timer activates the following items for a predetermined time interval: a red warning light, a constantly sounding warning sound, and the relay for disposal activation. The activation of the relay for disposal activation supplies power to the garbage disposal to make the disposal run. When the predetermined time interval ends on the disposal timer, this turns off the red warning light, the warning sound, the relay for disposal activation, and the garbage disposal.

The black box also contains a single shot latching relay that is activated when the dishwasher is initially turned on. This single shot latching relay allows the control box to be activated only once during a given wash cycle of the dishwasher.

DETAILED DESCRIPTION OF THE PREFERRED EMBODIMENT

Figures 1, 2:
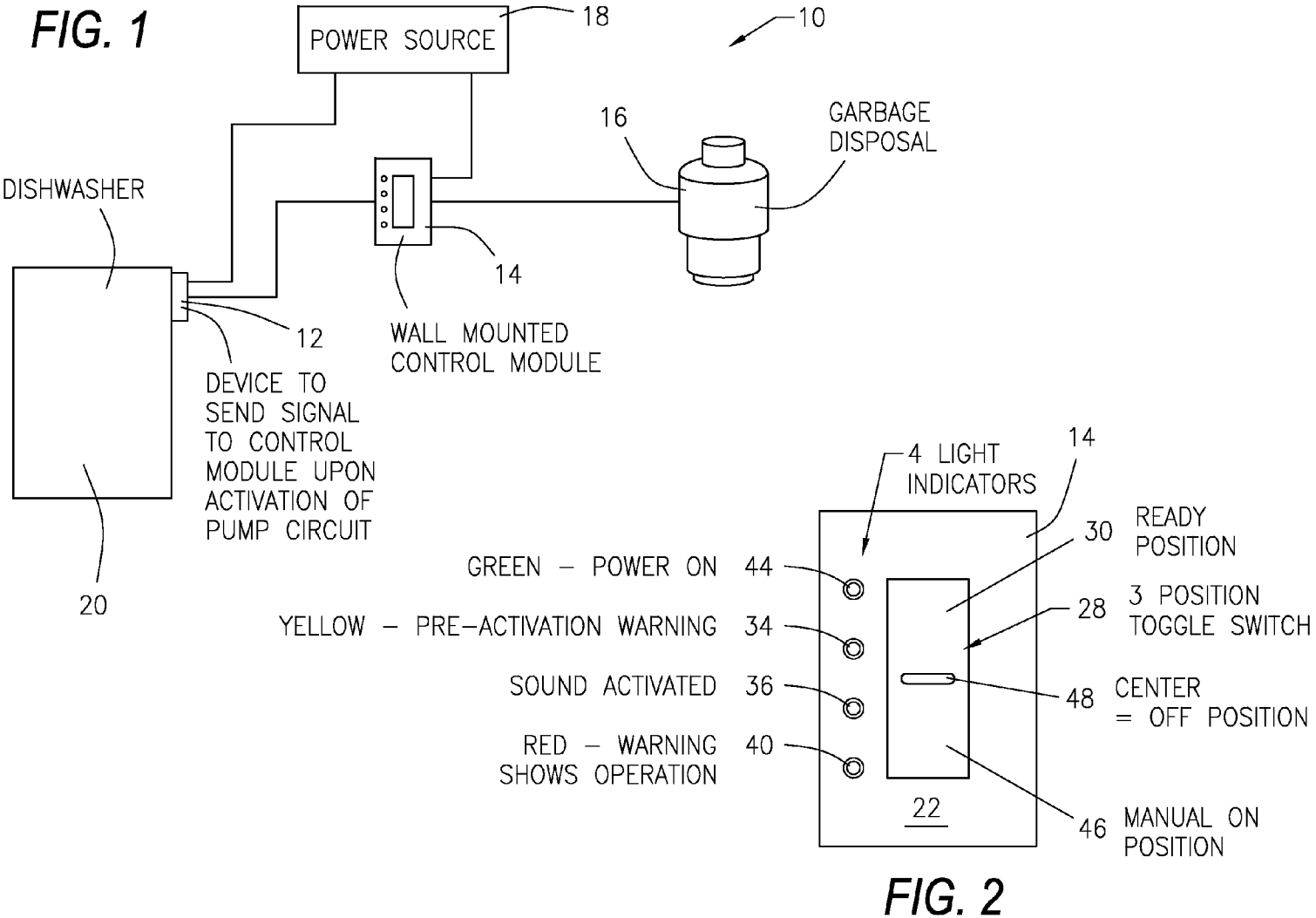
FIG. 1 is diagram showing the basic components of the invention and how they connect with a dishwasher, a garbage disposal, and a power source.
FIG. 2 is an enlarged view of the wall mounted control module which receives a signal from the device attached to the dishwasher and in turn operates the garbage disposal.

Referring now to the drawings and initially to FIG. 1, there is illustrated a dishwasher controlled garbage disposal system 10 that is constructed in accordance with a preferred embodiment of the present invention. The invention 10 involves three basic components 12, 14, and 16 that are functionally linked together and supplied with power from the home's electrical power source or supply 18. The first component is a black box device 12 that is functionally attached to the home's existing dishwasher 20. The second component is a wall mounted control module 14 that replaces the home's standard wall mounted garbage disposal electrical control switch (not illustrated). The third component is the home's existing garbage disposal 16.

The black box 12 is attached to the dishwasher's water pump circuitry (not illustrated) so that it detects when the dishwasher 20 is about to pump water out of the dishwasher 20. Upon detection of the dishwasher's water pump activation, the black box 12 sends a signal to a wall mounted control module 14. This signal may be sent in a variety of ways and by a variety of means. For example, the signal may be an electrical impulse sent over a hard wired system, it may be a radio frequency signal, or any other suitable type of signal that can be transmitted by the black box 12 and received by the wall mounted control module 14.

An enlarged view of the face 22 of the wall mounted control module 14 is shown in FIG. 2. The wall mounted control module 14 replaces the existing wall mounted garbage disposal switch in the home.

Figure 3:
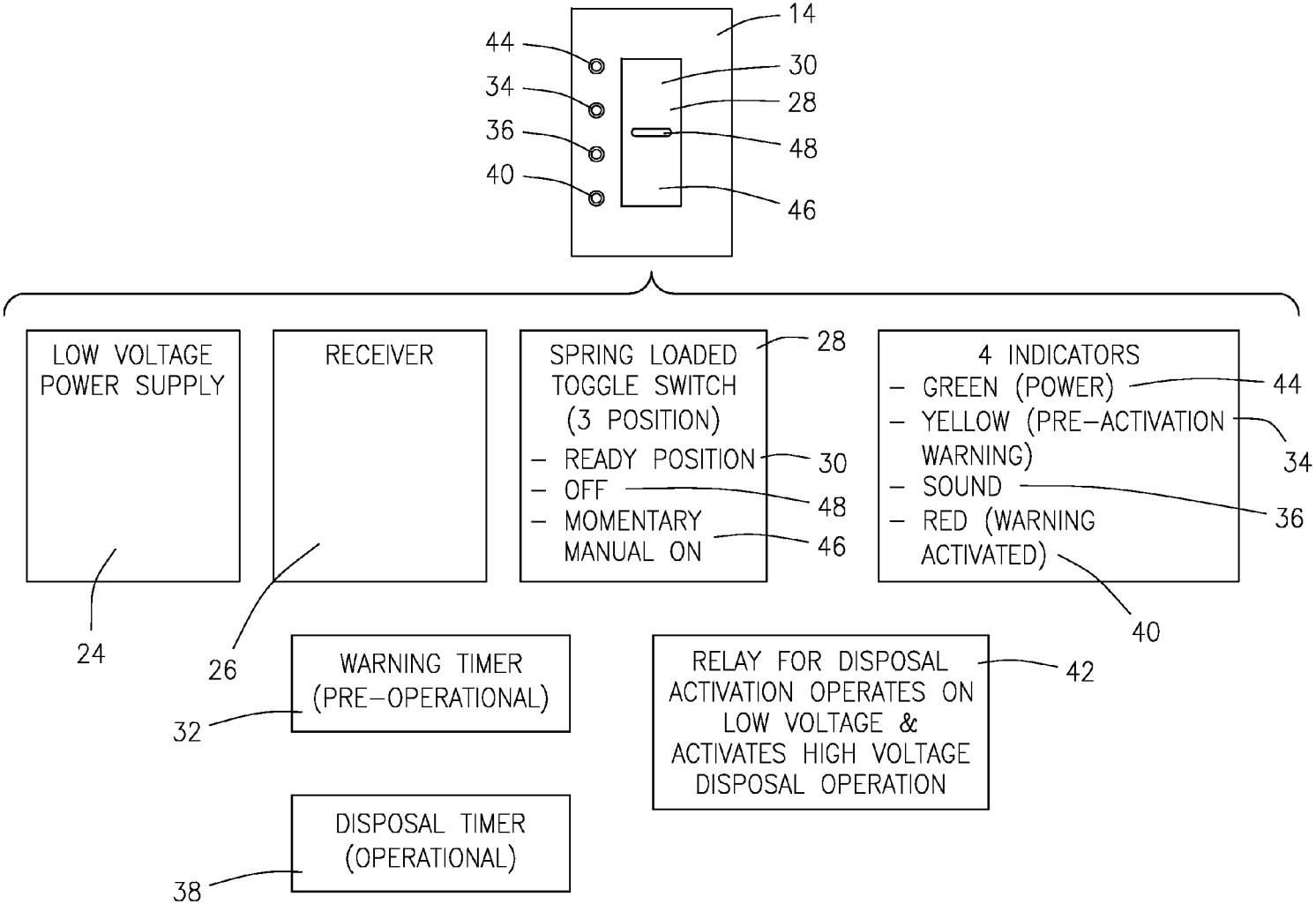
FIG. 3 is a diagram showing the various components contained within the wall mounted control module of FIG. 2.

As shown in FIG. 3, the wall mounted control module or box 14 has a low voltage power source 24 that converts the alternating electrical power received from the house's normal power source 18 to a lower voltage direct current that can be used by the control box 14. As illustrated in FIG. 1, the house's power source 18 also supplies power to the black box 12, the dishwasher 20, and the garbage disposal 16.

The various subcomponents of the control box 14 are shown in FIG. 3. When the signal from the black box 12 is received by the receiver 26 located within the control module 14 and when the three way toggle switch 28 provided on the control module is in its upper ready position 30, the signal activates a pre-operational warning timer 32 which in turn activates the following items for a short predetermined time interval: a yellow pre-activation warning light 34 on the face 22 of the wall mounted control box 14, and a fluctuating warning sound and sound indicating light 36 that is also located on the face 22 of the wall mounted control box 14. At the end of the time interval set for the pre-operational warning timer 32, this warning timer 32 times out and turns off the yellow light 34 and the fluctuating warning sound and associated sound indicating light 36 and also then activates the disposal timer 38.

Activation of the disposal timer 38 causes the activation of the following items for a predetermined time interval: a red warning light 40 located on the face 22 of the wall mounted control box 14, a constantly sounding warning sound and the associated sound indicating light 36 located on the face 22 of the wall mounted control box 14, and a relay for disposal activation 42. The activation of the relay for disposal activation 42 supplies power to the garbage disposal 16 to make the disposal 16 run.

When the predetermined time interval ends on the disposal timer 38, this turns off the red warning light 40, the warning sound and associated sound indicating light 36, the relay for disposal activation 42, and the garbage disposal 16.

As shown in FIG. 2, the wall mounted control box also is provided with a green power light 44 that is lighted whenever there is power to the control box 14 and the toggle switch 28 is either in the upper ready position 30 or in the lower manual on position 46. By placing the toggle switch 28 in the lower manual on position 46, the garbage disposal 16 can be manually activated independent of the of the dishwasher controlled garbage disposal system 10. When the toggle switch 28 is in the center off position 48, the green power light 44 is not lighted.

Although not illustrated, the black box device 12 also preferably contains internally a single shot latching relay that is activated when the dishwasher 20 is initially turned on. This single shot latching relay allows the control box 14 to be activated only once during a given wash cycle of the dishwasher 20, thereby preventing the garbage disposal 16 from being activated unnecessarily each time the water pump of the dishwasher 20 is activated during the dishwasher's wash cycle.

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claim or claims, including the full range of equivalency to which each element thereof is entitled.

What is claimed is:

1. A dishwasher controlled garbage disposal system comprising:

a signal detection and transmission device functionally attached to a dishwasher that detects activation of the dishwasher's water pump and capable of transmitting a signal to a control module upon detection of activation of the dishwasher's water pump, and the control module functionally attached to a garbage disposal so that it activates the garbage disposal upon receiving a signal from the signal detection and transmission device.

2. A dishwasher controlled garbage disposal system according to claim 1 further comprising:

a pre-operational warning timer provided on the control module which receives the signal from the signal detection and transmission device and activates for a short time a warning to the user that the garbage disposal is about to activate prior to activation of the garbage disposal.

3. A dishwasher controlled garbage disposal system according to claim 2 wherein the warning to the user that the garbage disposal is about to activate further comprises:

a pre-activation yellow warning light located on the control module.

4. A dishwasher controlled garbage disposal system according to claim 2 wherein the warning to the user that the garbage disposal is about to activate further comprises:

a fluctuating warning sound and light located on the control module.

5. A dishwasher controlled garbage disposal system according to claim 2 further comprising:

a disposal timer provided on the control module which activates upon expiration of time on the pre-operational warning timer to thereby activate for a short time an operational warning and a relay which activates the garbage disposal.

6. A dishwasher controlled garbage disposal system according to claim 5 wherein the operational warning further comprises:

a red warning light located on the control module.

7. A dishwasher controlled garbage disposal system according to claim 5 wherein the operational warning further comprises:

a constantly sounding warning sound and light located on the control module.

8. A dishwasher controlled garbage disposal system according to claim 5 further comprising:

a single shot latching relay provided on the signal detection and transmission device which is activated when the dishwasher is initially turned on and prevents the control module from being activated more than once during a given wash cycle of the dishwasher.

9. A dishwasher controlled garbage disposal system according to claim 8 further comprising:

a three position toggle switch provided on the control module, the toggle switch provided with an on position as a manual override to allow manual activation of the garbage disposal independent of the functioning of the dishwasher.

10. A dishwasher controlled garbage disposal system according to claim 9 further comprising:

the toggle switch provided with an off position to prevent the garbage disposal from being activated.

11. A dishwasher controlled garbage disposal system according to claim 10 further comprising:

the toggle switch provided with a ready position to allow the dishwasher operation to automatically control the activation of the garbage disposal.

* * * * *